US007850825B2

(12) United States Patent
Scherb et al.

(10) Patent No.: US 7,850,825 B2
(45) Date of Patent: Dec. 14, 2010

(54) TISSUE MACHINE

(75) Inventors: Thomas Scherb, Sao Paulo (BR); Luiz Carlos Silva, Campo Limpo (BR); Rogerio Berardi, Sao Paulo (BR); Danilo Oyakawa, Sao Paulo (BR)

(73) Assignee: Voith Patent GmbH, Heidenheim (DE)

( * ) Notice: Subject to any disclaimer, the term of this patent is extended or adjusted under 35 U.S.C. 154(b) by 21 days.

(21) Appl. No.: 12/122,012

(22) Filed: May 16, 2008

(65) Prior Publication Data

US 2008/0251227 A1 Oct. 16, 2008

(51) Int. Cl.
*D21F 7/02* (2006.01)
*D21F 3/00* (2006.01)
*D21F 5/00* (2006.01)

(52) U.S. Cl. ..... 162/358.3; 162/358.1; 162/358.4; 162/361; 162/901; 162/902

(58) Field of Classification Search ... 162/358.1–358.5, 162/361, 363, 368–370, 900–903; 34/114–116, 34/122–124
See application file for complete search history.

(56) References Cited

U.S. PATENT DOCUMENTS 5,753,085 A * 5/1998 FitzPatrick ..... 162/358.4
5,792,323 A * 8/1998 Grondahl ..... 162/358.4
5,908,536 A * 6/1999 Kaasalainen et al. ..... 162/205
7,150,110 B2 * 12/2006 Herman et al. ..... 34/399
7,291,249 B2 * 11/2007 Thoroe-Scherb et al. . 162/358.1
7,351,307 B2 * 4/2008 Scherb et al. ..... 162/115
7,428,786 B2 * 9/2008 Herman et al. ..... 34/399
7,476,293 B2 * 1/2009 Herman et al. ..... 162/206
7,476,294 B2 * 1/2009 Herman et al. ..... 162/206
7,510,631 B2 * 3/2009 Scherb et al. ..... 162/358.1
7,527,709 B2 * 5/2009 Lippi Alves Fernandes et al. ..... 162/358.4
7,582,187 B2 * 9/2009 Scherb et al. ..... 162/112
7,691,230 B2 * 4/2010 Scherb et al. ..... 162/116
2002/0062936 A1 5/2002 Klerelid et al.
2003/0136018 A1 * 7/2003 Herman et al. ..... 34/114
2004/0237210 A1 * 12/2004 Thoroe-Scherb et al. ... 8/115.51
2005/0126031 A1 * 6/2005 Herman et al. ..... 34/114
2005/0167061 A1 * 8/2005 Scherb et al. ..... 162/115
2005/0167062 A1 * 8/2005 Herman et al. ..... 162/115
2005/0167066 A1 * 8/2005 Herman et al. ..... 162/203
2005/0167067 A1 * 8/2005 Crook et al. ..... 162/348
2006/0085999 A1 * 4/2006 Scherb et al. ..... 34/453

(Continued)

FOREIGN PATENT DOCUMENTS

CA 2 554 396 A1 8/2005

(Continued)

*Primary Examiner*—José A Fortuna
(74) *Attorney, Agent, or Firm*—Taylor IP, P.C.

(57) ABSTRACT

An apparatus for producing a fibrous web, in particular a tissue web, with a press zone through which the fibrous web is passed in a lying position between a circulating permeable structured belt and a circulating permeable non-structured supporting belt. A press nip is provided on a Yankee Cylinder through which the fibrous web is passed in the lying position together with the structured belt between the structured belt and the Yankee cylinder, whereby the press zone is limited on the side adjacent the supporting belt by a substantially smooth surface, and whereby the supporting belt is not brought together with the fibrous web and the structured belt until proximate to the press zone.

23 Claims, 2 Drawing Sheets

U.S. PATENT DOCUMENTS

| | | | | |
|---|---|---|---|---|
| 2007/0062657 | A1* | 3/2007 | Scherb et al. | 162/117 |
| 2007/0074835 | A1* | 4/2007 | Scherb et al. | 162/112 |
| 2007/0074837 | A1* | 4/2007 | Scherb et al. | 162/205 |
| 2007/0240842 | A1* | 10/2007 | Scherb et al. | 162/205 |
| 2007/0256806 | A1* | 11/2007 | Scherb et al. | 162/358.4 |
| 2008/0073051 | A1* | 3/2008 | Herman et al. | 162/204 |
| 2008/0128104 | A1* | 6/2008 | Scherb et al. | 162/358.2 |
| 2008/0196855 | A1* | 8/2008 | Herman et al. | 162/205 |
| 2008/0251227 | A1* | 10/2008 | Scherb et al. | 162/357 |
| 2009/0165979 | A1* | 7/2009 | Scherb et al. | 162/210 |
| 2009/0165980 | A1* | 7/2009 | Scherb et al. | 162/210 |

FOREIGN PATENT DOCUMENTS

| | | | |
|---|---|---|---|
| DE | 10129613 | A1 * | 1/2003 |
| DE | 102005054510 | A1 * | 5/2007 |
| EP | 1626121 | A1 * | 2/2006 |
| EP | 1770209 | A1 * | 4/2007 |
| WO | WO 03000002 | A1 * | 1/2003 |
| WO | WO 2005075736 | A2 * | 8/2005 |
| WO | WO 2006045689 | A1 * | 5/2006 |
| WO | WO 2007057322 | A2 * | 5/2007 |

* cited by examiner

TISSUE MACHINE

BACKGROUND OF THE INVENTION

1. Field of the Invention

The present invention relates to an apparatus for producing a fibrous web, in particular a tissue web.

2. Description of the Related Art

Tissue paper ideally possesses a high absorbency and a high water absorption capacity in connection with a high tear resistance. The absorbency and water absorption capacity are defined essentially by the volume and porosity of the tissue paper.

To increase the volume it has already been proposed to press the tissue paper web during its production only on a zone basis in order to obtain, in addition to the pressed regions of greater tear resistance, more voluminous regions that are only slightly pressed or unpressed.

During the production of tissue paper the tissue web is conveyed in a final drying step over the circumferential surface of a heated Yankee drying cylinder before the finished product is crêped by the cylinder.

What is needed in the art is an apparatus which will more efficiently produce tissue paper with a high absorbency and water absorption capacity in connection with a high tear resistance. The result should be a better formation of the produced fibrous web and tissue web.

SUMMARY OF THE INVENTION

The present invention provides an apparatus for producing a fibrous web, in particular a tissue web, with a press zone through which the fibrous web is passed in a lying position between a circulating permeable structured belt and a circulating non-structured permeable supporting belt. A press nip is provided on a Yankee cylinder through which the fibrous web is passed in a lying position together with the structured belt between the structured belt and the Yankee cylinder, whereby the press zone is limited on the side adjacent the supporting belt by a substantially smooth surface, and whereby the supporting belt is not brought together with the fibrous web and the structured belt until proximate to the press zone.

As a result of this construction it is assured that no excessively high forces arise between the fibrous web and the circulating non-structured permeable supporting belt upstream from the press zone in the web running direction. Up to now such has been the case, for example, in the region of deflecting rolls over which the supporting belt was passed jointly with the fibrous web and the circulating permeable structured belt. Too intensive a deflection of the sandwich "supporting belt, fibrous web, structured belt," for example, in the region of a deflecting roll, upstream from the press zone in the web running direction is thus prevented according to the present invention. The forces acting on the fibrous web are reduced accordingly, thus resulting in a better formation.

After the fibrous web is pressed in a lying position in the press zone between the circulating permeable structured belt and a circulating permeable non-structured belt, or substantially smooth permeable supporting belt, the tissue web can be brought with a relatively smooth side into contact with the Yankee drying cylinder while only part of the fibrous web or tissue web is pressed as the result of the structured belt lying on the other web side. Unlike on the conventional through air drying (TAD) machines, approximately 100% of the surface of the side of the tissue web in question can thus come into contact with the Yankee cylinder while only a part of it is pressed.

Because the fibrous web is dewatered further through the supporting and/or dewatering belt to the side facing away from the structured belt, the fibers are thrust in the direction of the substantially smooth surface of the circulating permeable non-structured supporting belt which is formed by a dewatering belt. The dewatering can be effected by an accordingly high vacuum and/or mechanically, by way of a tensioning belt which is used to press the circulating permeable structured belt, the fibrous web and the circulating permeable non-structured supporting belt against a smooth surface. The gas current in question thus flows sequentially through the substantially permeable structured belt, then the fibrous web and finally through the circulating permeable non-structured supporting belt. By contrast, with a conventional TAD method the gas current flows first through the fibrous web and then through the circulating permeable structured belt. Unlike with the present invention, such a conventional TAD method the fibrous web is not invested with a smooth surface. Apart from this, the differential pressure generated with the conventional TAD method is relatively small.

In one embodiment of the present invention an apparatus produces a fibrous web, in particular a tissue web, with a press zone through which the fibrous web is passed in lying position between a circulating permeable structured belt and a circulating non-structured permeable supporting belt. A press nip is provided on a Yankee cylinder through which the fibrous web is passed in lying position together with the structured belt between the structured belt and the Yankee cylinder, whereby the press zone is limited on the side adjacent the supporting belt by a substantially smooth surface. The supporting belt is brought together with the fibrous web and the structured belt in a region which precedes the press zone in the web running direction and in which the fibrous web and the structured belt extend in a substantially straight line. Alternatively, the supporting belt is brought together with the fibrous web and the structured belt in the region of a deflecting roll preceding the press zone in the web running direction and the wrap angle through which the structured belt, the fibrous web and the supporting belt jointly enwrap the deflecting roll is less than approximately 45°.

With this inventive solution the occurrence of excessively high forces between the fibrous web and the permeable supporting belt upstream from the press zone is counteracted in that the supporting belt is brought together with the fibrous web and the structured belt in a region which precedes the press zone in the web running direction and in which the fibrous web and the structured belt run in a substantially straight line, or, in the alternative, the supporting belt is brought together with the fibrous web and the structured belt in the region of a deflecting roll preceding the press zone in the web running direction and the wrap angle through which the structured belt and the fibrous web and the supporting belt jointly enwrap the deflecting roll is less than approximately 45°. An improved formation of the fibrous web is obtained as the result of the prevention of excessively high forces between the fibrous web and the supporting belt upstream from the press zone due to excessive deflection in the region of a deflecting roll or the like.

Upstream from the press zone in the running direction of the fibrous web the present inventive apparatus has a sheet forming zone in which the fibrous web is formed on a circulating permeable structured belt. As the fibrous web is already formed on a circulating permeable structured belt, the depressions of the structured belt are filled with fibers instead of the fibers of an already formed web being sucked into the depressions of the structured belt as happens with a conventional TAD method. As a result, regions of the fibrous web with a higher grams per square meter (gsm) substance are formed in the depressions of the structured belt.

The fibrous web is transported in this case through the press zone on the structured belt on which it is formed. As a result, the formed fibrous web must no longer be transferred onto the structured belt with which it is transported through the press zone.

In one embodiment of the present invention, the supporting belt runs onto a substantially smooth surface upstream from the fibrous web and the structured belt in the web running direction.

In another embodiment of the present invention there is a wrap angle through which the structured belt, the fibrous web, and the supporting belt jointly enwrap the deflecting roll over an angle that is less than approximately 15° and preferably less than approximately 10°.

The deflecting roll can have a diameter less than 1.2 meter or less than 0.8 meter or less than 0.6 meter.

The embodiments mentioned in the following, by way of examples, are conceivable in principle for both variants of the invention.

The substantially smooth surface limiting the press zone on the side adjacent the supporting belt can be formed by a curved surface. In this case the curved surface limiting the press zone on the side adjacent the supporting belt is formed by a rotating roll.

It is also an advantage for provision to be made for the generation, in the region of the press zone, of a gas current which flows through the structured belt, the fibrous web and the supporting belt. The direction of the gas current is orientated to flow sequentially through the structured belt, the fibrous web to the supporting belt. Provision can be made for the generation of an air current and/or a steam current.

According to an advantageous practical embodiment of the respective apparatus, the device for generating a gas current includes a rotating suction roll which is equipped with a suction zone and limits the press zone on the side adjacent the supporting belt. The curved, substantially smooth surface is thus formed in this case by the rotating suction roll.

The gas current can be generated at least in part also by a flat or curved suction box or the like which limits the press zone on the side adjacent the supporting belt.

The gas current can also be generated, at least in part, by way of an excess pressure hood arranged on the side of the permeable structured belt.

Alternatively or in addition, the structured belt, the fibrous web and the supporting belt can be pressed against the substantially smooth surface advantageously by way of a tensioned air-permeable press belt. In this case the substantially smooth surface can again be formed by a rotating roll.

In this case it can be an advantage for the gas current to be generated, at least in part, by way of an excess pressure hood arranged in the loop of the press belt in the press section.

Another advantageous embodiment of the present invention is provided in that the beginning of the suction zone is arranged in the suction roll or the suction box upstream from the beginning of the press zone.

The structured belt provided is a structured mesh.

According to a preferred practical embodiment of the present inventive apparatus, a TAD mesh is the structured belt.

The supporting belt can be a dewatering belt, preferably a felt or a mesh.

Preferably the relatively depressed and the relatively raised regions of the structured belt are constructed and arranged relative to each other such that a maximum 35% and preferably a maximum 25% of the structured belt are pressed in the press nip.

As gentle a pressing as possible is obtained through the press nip arranged on the Yankee cylinder being a shoe press nip or a conventional roll press nip.

The mating roll can be formed by a conventional press roll or a suction press roll.

The fibrous web in the region of the press nip is transferred from the structured belt onto the surface of the Yankee cylinder. In the press nip the fibrous web thus lies between the structured belt and the Yankee cylinder. The fibrous web taken back off the Yankee cylinder is fed to a winding apparatus.

It is an advantage to provide at least one suction box with a hole pattern upstream from the press zone in the web running direction. Alternatively or in addition, such a suction box with a hole pattern can be provided downstream from the press zone as well.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
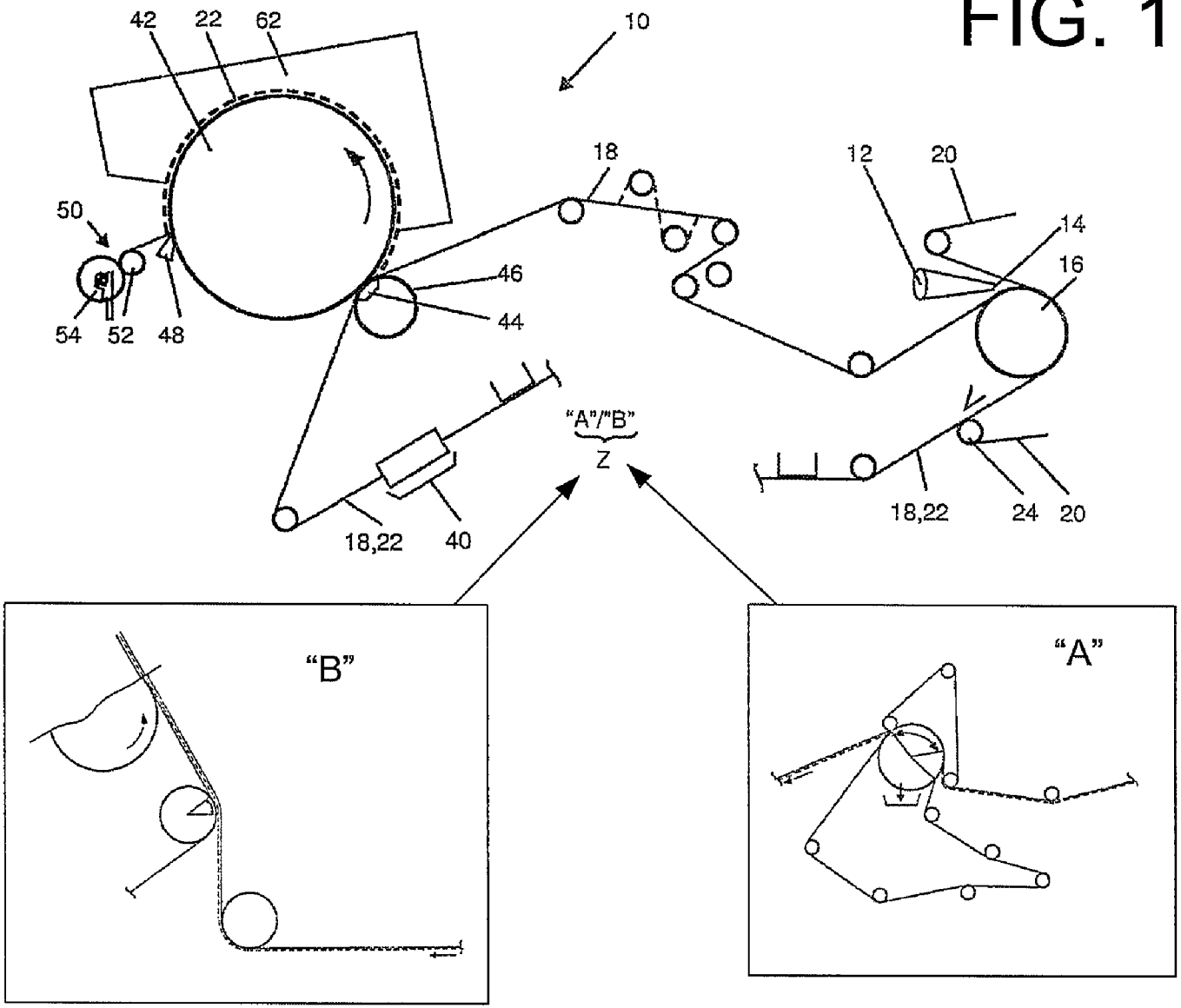
FIG. 1 shows a representation of an embodiment of an apparatus for producing a fibrous web, in particular a tissue web, which can be constructed in an area Z lying between the sheet forming zone and the Yankee cylinder, alternatively according to the representation "A" in FIG. 2 or according to the representation "B" in FIG. 3.
Figure 2:
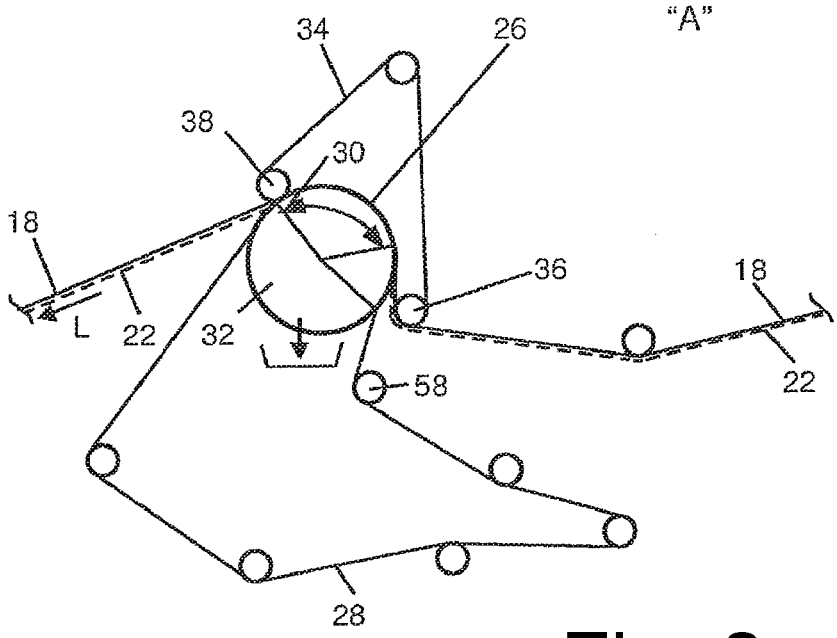
FIG. 2 is a schematic representation of an embodiment "A" of the area Z lying between the sheet forming zone and the Yankee cylinder of the apparatus according to FIG. 1.
Figure 3:
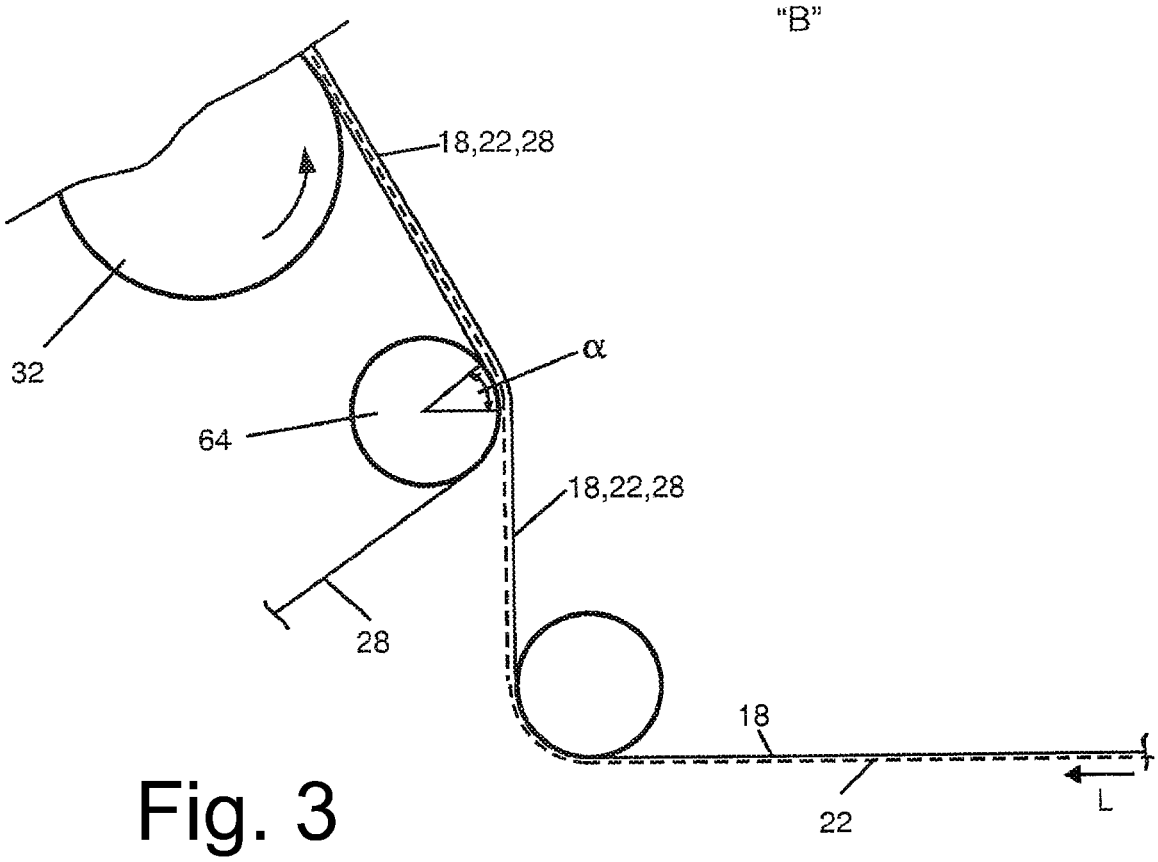
FIG. 3 is a schematic representation of an embodiment "B" of the area Z lying between the sheet forming zone and the Yankee cylinder of the apparatus according to FIG. 1.

Referring now to the drawings, and more particularly to FIGS. 1-3, there is shown a schematic representation of an embodiment of an apparatus 10 for producing a fibrous web, the web in the case in question being a tissue web 22.

According to one embodiment of the present invention, represented by FIG. 1 in conjunction with FIG. 2, a headbox 12 delivers a pulp suspension jet into an intake nip 14, which is formed in the region of a forming roll 16 between an inner lying circulating permeable structured belt 18 and an outer lying circulating forming mesh 20, which run together in the region of forming roll 16 and then are passed jointly around forming roll 16.

Structured belt 18 can be a three-dimensionally structured mesh or TAD mesh.

Forming mesh 20 faces tissue web 22 with a relatively smooth side compared to the side in connection with structured belt 18.

By contrast, the side of structured belt 18 facing tissue web 22 has depressed regions and raised regions, whereby tissue web 22 is formed in the depressed and raised regions of structured belt 18.

In the region of forming roll 16, tissue web 22 is dewatered essentially by the outer lying forming mesh 20. Forming mesh 20 is then separated again, in the region of deflecting roll 24, from tissue web 22, which together with structured belt 18 is transported on to press zone 26 (cf. FIG. 2) in which tissue web 22 is pressed in lying position between structured belt 18 and a circulating non-structured permeable supporting belt 28. Permeable supporting belt 28 can be a dewatering belt, made of felt or mesh.

In the region of press zone 26, pressure is exerted on structured belt 18, tissue web 22 and supporting belt 28 such that tissue web 22 is dewatered in the direction of supporting belt 28 formed by a dewatering belt.

Because tissue web 22 is dewatered in press zone 26 in the direction of permeable supporting belt 28 and because structured belt 18 transported through said press zone 26 is identical with the structured belt on which the tissue web 22 was formed, the more voluminous areas of the tissue web 22 are less intensively compressed than the less voluminous areas, thus resulting in the voluminous structure of the more voluminous areas in question being preserved.

The dewatering pressure for tissue web 22 is generated in press zone 26, at least in some areas, simultaneously by a gas current and a mechanical pressing force. The gas current flows sequentially first through structured belt 18, tissue web 22, and finally through permeable supporting belt 28. As is evident from FIG. 1, the gas current is generated in the case in question by suction zone 30 of suction roll 32.

The alternatively or additionally applied mechanical force is generated by structured belt 18, tissue web 22 and supporting belt 28 being transported in press zone 26 between a tensioned press belt 34 and a substantially smooth surface, which here is formed by roll 32.

Press zone 26 is defined by the wrap zone of press belt 34 around the circumferential surface of suction roll 32.

Press belt 34 is tensioned on suction roll 32 by two deflecting rolls 36 and 38, whereby structured belt 18 and fibrous web 22 come to lie between press belt 34 and suction roll 32. Structured belt 18 and fibrous web 22 are brought together with press belt 34 in the region of deflecting roll 36. Directly after deflecting roll 36, press belt 34, structured belt 18 and tissue web 22 are transported jointly to suction roll 32, whereby suction zone 30 begins at the point at which press belt 34, structured belt 18 and fibrous web 22 run onto suction roll 32. Suction zone 30 ends in the region of deflecting roll 38, where press belt 34 is moved up and away from structured belt 18 and fibrous web 22. In this region structured belt 18 and tissue web 22 also run off suction roll 32 again.

Structured belt 18 and tissue web 22 run, in the starting region of suction zone 30, onto suction roll 32 which is enwrapped by supporting belt 28, whereby supporting belt 28 is not brought together with fibrous web 22 and structured belt 18 until in the region of this run-on point of structured belt 18 and fibrous web 22, meaning not until in the region of press zone 26 or suction zone 30.

As is evident from FIG. 2, supporting belt 28 runs onto the substantially smooth surface of suction roll 32, upstream from fibrous web 22 and structured belt 18. In the region of the run-on point of supporting belt 28 onto suction roll 32, supporting belt 28 is passed around deflecting roll 58.

Directly after press zone 26, structured belt 18 is transported together with tissue web 22 through a region 40 (cf. FIG. 1) in which tissue web 22 can be subjected to at least one more drying step.

Directly afterwards, fibrous web 22 is passed together with structured belt 18 through press nip 44 formed on a drying cylinder, namely Yankee cylinder 42. In this case, tissue web 22 lies in press nip 44 between structured belt 18 and the smooth surface of Yankee cylinder 42. Press nip 44 is formed, for example, by a shoe press nip. Assigned to Yankee cylinder 42 in order to form press nip 44 is therefore a shoe press unit, in this case shoe press roll 46. As is evident from FIG. 1, a hood 62 can be assigned to Yankee cylinder 42.

As the result of tissue web 22 having been formed between structured mesh 18 and substantially smooth forming mesh 20, only the side of tissue web 22 formed on structured belt 18 has a corrugated surface. By contrast, the surface of tissue web 22 formed on smooth forming mesh 20 is relatively smooth. With said smooth side tissue web 22 now comes into contact in press nip 44 with the surface of Yankee cylinder 42. Tissue web 22 thus touches Yankee cylinder 42 with a relatively large area. Because structured belt 18 transported through press nip 44 is identical with the structured belt on which tissue web 22 was formed, it is assured that the more voluminous regions of tissue web 22 are practically not pressed likewise in said press nip 44. By contrast, the less voluminous regions of the tissue web 22 are pressed, thus increasing further the strength of tissue web 22.

Directly after press nip 44, structured belt 18 is separated from tissue web 22, which is transported on Yankee cylinder 42 as far as doctor blade 48, by way of which tissue web 22 is creped and lifted off Yankee cylinder 42. Then tissue web 22 is fed to a take-up unit 50 on which it is wound, with the help of press-on roll 52, into coil 54. Hence fibrous web 22 is transferred in the region of press nip 24 from structured belt 18 onto the surface of Yankee cylinder 42.

An air current and/or steam current can be generated as the gas current which in press zone 26 flows first through structured belt 18, then through tissue web 22 and finally through supporting belt 28 (cf. FIG. 2).

Alternatively or in addition to suction roll 22, the gas current can be generated at least in part also by way of an excess pressure hood (not shown here) which is arranged on the side of permeable structured belt 18.

The relatively depressed and the relatively raised regions of structured belt 18 are constructed and arranged relative to each other preferably such that a maximum 35% and preferably a maximum 25% of the structured belt 18 are pressed in the press nip formed with Yankee cylinder 42.

Another embodiment of the present invention represented in FIG. 1 in conjunction with FIG. 3 differs from the first in that supporting belt 28 is brought together with fibrous web 22 and structured belt 18 in a region which precedes press zone 26 in the web running direction and in which fibrous web 22 and structured belt 18 run in substantially a straight line, or supporting belt 28 is brought together with fibrous web 22 and structured belt 18 in the region of deflecting roll 64 preceding press zone 26 in the web running direction (cf. FIG. 3) and the wrap angle $\alpha$ through which structured belt 18, fibrous web 22, and supporting belt 28 jointly enwrap deflecting roll 64 is selected to be less than approximately 45°.

In this case the wrap angle $\alpha$ through which structured belt 18, tissue web 22, and supporting belt 28 jointly enwrap deflecting roll 64 can be less than approximately 15°, whereby it is selected preferably less than around 10°.

Supporting belt 28 is brought together with tissue web 22 and structured belt 18 in a region in which they run, at least essentially, in a straight line or the wrap angle α, through which structured belt 18, tissue web 22 and supporting belt 28 are passed jointly around deflecting roll 64, is selected to be as small as possible, the forces arising between tissue web 22 and supporting belt 28 upstream from press zone 26 are kept as low as possible, thus resulting again in a better formation of the produced tissue web 22.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

10 Apparatus
12 Headbox
14 Inlet nip
16 Forming roll
18 Structured belt
20 Forming mesh
22 Tissue web
24 Deflecting roll
26 Press zone
28 Supporting belt
30 Suction zone
32 Suction roll
34 Press belt
36 Deflecting roll
38 Deflecting roll
40 Region
42 Yankee cylinder
44 Press nip
46 Show press roll
48 Doctor blade
50 Take-up unit
52 Press-on roll
54 Coil
58 Deflecting roll
62 Hood
64 Deflecting roll
α Wrap angle

What is claimed is:

1. An apparatus for producing a fibrous web, the fibrous web being a tissue web, the apparatus comprising:

a circulating permeable structured belt;

a circulating non-structured supporting belt, the fibrous web passing in lying position between said circulating structured belt and said circulating non-structured supporting belt in a press zone;

a supporting surface having a substantially smooth surface, wherein said non-structured supporting belt runs onto said substantially smooth surface upstream from where said fibrous web contacts said non-structured support belt; and a Yankee cylinder having a press nip through which the fibrous web is passed in lying position together with said circulating permeable structured belt, said permeable structured belt including a plurality of raised and depressed regions constructed and arranged relative to each other such that a maximum of 35% of said structured belt is pressed in said press nip, the fibrous web being between said circulating permeable structured belt and said Yankee cylinder, said press zone being limited on a side adjacent said supporting belt by said substantially smooth surface, said circulating non-structured supporting belt not being brought together with the fibrous web and said circulating structured belt until being proximate to said press zone.

2. The apparatus of claim 1 wherein upstream from said press zone in a running direction of the fibrous web there is a sheet forming zone in which the fibrous web is formed on said circulating permeable structured belt.

3. The apparatus of claim 2 wherein the fibrous web is transported through said press zone on said circulating permeable structured belt on which the fibrous web is formed.

4. The apparatus of claim 2, wherein said supporting surface is a deflecting roll, said circulating permeable structured belt and the fibrous web and said supporting belt jointly enwrap said deflecting roll over a wrap angle of less than approximately 15°.

5. The apparatus of claim 4, wherein said wrap angle is less than approximately 10°.

6. The apparatus of claim 1, wherein said substantially smooth surface is a curved surface.

7. The apparatus of claim 6, wherein said curved surface is a rotating roll.

8. The apparatus of claim 7, wherein said rotating roll is configured for passage of a gas current through said circulating permeable structured belt, the fibrous web and said circulating non-structured supporting belt.

9. The apparatus of claim 8 wherein said gas current has a direction of flow orientated to flow sequentially through said circulating permeable structured belt, the fibrous web and said circulating non-structured supporting belt.

10. The apparatus of claim 8, further comprising a device to generate said gas current, said gas current being one of an air current and a steam current.

11. The apparatus of claim 10, wherein said device is a rotating suction roll having a suction zone, said suction zone limiting said press zone on a side adjacent said circulating non-structured supporting belt.

12. The apparatus of claim 10, wherein said device is one of a flat and a curved suction box, said suction box limiting said press zone on a side adjacent said circulating non-structured supporting belt.

13. The apparatus of claim 10, wherein said device is an excess pressure hood arranged on a side of said circulating permeable structured belt.

14. The apparatus of claim 6, further comprising a tensioned air-permeable press belt, said circulating permeable structured belt, the fibrous web, and said circulating permeable non-structured belt being pressed against said substantially smooth surface by said tensioned air-permeable press belt.

15. The apparatus of claim 14, wherein said substantially smooth surface is a rotating roll.

16. The apparatus of claim 1, wherein said circulating permeable structured belt is a structured mesh.

17. The apparatus of claim 1, wherein said circulating permeable structured belt is a through air dryer mesh.

18. The apparatus of claim 1, wherein said non-structured permeable supporting belt is a dewatering belt, said dewatering belt being one of felt and mesh.

19. The apparatus of claim 1, wherein said depressed and raised regions are arranged relative to each other such that a maximum of 25% of said circulating permeable structured belt is pressed in said press nip.

20. The apparatus of claim 1, wherein said press nip provided on said Yankee cylinder is one of a shoe nip and a roll press nip.

21. The apparatus of claim 1, wherein the fibrous web is transferred proximate to said press nip from said circulating permeable structured belt onto a surface of said Yankee cylinder.

22. The apparatus of claim 1, further comprising a winding device the fibrous web being removed from said Yankee cylinder and fed to said winding device.

23. An apparatus for producing a fibrous web, the fibrous web being a tissue web, the apparatus comprising:

a circulating permeable structured belt;

a circulating non-structured supporting belt, the fibrous web passing in lying position between said circulating structured belt and said circulating non-structured supporting belt in a press zone;

a deflecting roller;

a supporting surface having a substantially smooth surface; and a Yankee cylinder having a press nip through which the fibrous web is passed in lying position together with said circulating permeable structured belt, said circulating permeable structured belt including a plurality of raised and depressed regions constructed and arranged relative to each other such that a maximum of 35% of said structured belt is pressed in said press nip, the fibrous web being between said circulating permeable structured belt and said Yankee cylinder, said press zone being limited on a side adjacent said supporting belt by said substantially smooth surface, said circulating non-structured supporting belt being brought together with the fibrous web and said circulating structured belt, said supporting belt being brought together with the fibrous web and said permeable structured belt proximate to said deflecting roller preceding said press zone in a web running direction, said structured belt, the fibrous web and said supporting belt jointly enwrapping said deflecting roller over a wrap angle, said wrap angle being less than approximately 45 degrees.

* * * * *

UNITED STATES PATENT AND TRADEMARK OFFICE

CERTIFICATE OF CORRECTION

PATENT NO. : 7,850,825 B2
APPLICATION NO. : 12/122012
DATED : December 14, 2010
INVENTOR(S) : Thomas Scherb et al.

It is certified that error appears in the above-identified patent and that said Letters Patent is hereby corrected as shown below:

TITLE PAGE

After "US 2008/0251227 A1 October 16, 2008", please insert the following Items (62) and (30):

-- (62) Related U.S. Application Data
Continuation of application No. PCT/EP2006/068175, filed on Nov. 7, 2006.

(30) Foreign Application Priority Data
Nov. 16, 2005 (DE) ..... 10 2005 054 510.6 --.

Signed and Sealed this
Eighth Day of November, 2011

David J. Kappos

David J. Kappos
*Director of the United States Patent and Trademark Office*